US008671576B1

(12) United States Patent
Hotella

(10) Patent No.: US 8,671,576 B1
(45) Date of Patent: Mar. 18, 2014

(54) DIVISIBLE HEAD RAZOR DEVICE

(76) Inventor: Vernon P. Hotella, Cache, OK (US)

( * ) Notice: Subject to any disclaimer, the term of this patent is extended or adjusted under 35 U.S.C. 154(b) by 101 days.

(21) Appl. No.: 13/431,092

(22) Filed: Mar. 27, 2012

(51) Int. Cl.
*B26B 21/14* (2006.01)

(52) U.S. Cl.
USPC ..... 30/34.1; 30/50; 30/62; 30/526

(58) Field of Classification Search
USPC ..... 30/34.1, 47–51, 54, 60–63, 75, 79, 526
See application file for complete search history.

(56) References Cited

U.S. PATENT DOCUMENTS

| | | | | |
|---|---|---|---|---|
| 831,259 | A * | 9/1906 | Bingler | 30/63 |
| 1,241,921 | A * | 10/1917 | Carroll | 30/48 |
| 2,127,881 | A * | 8/1938 | Morris | 30/34.1 |
| 2,294,284 | A * | 8/1942 | Chu | 30/47 |
| 2,505,493 | A * | 4/1950 | Herrmann | 30/50 |
| 2,587,964 | A * | 3/1952 | Burns | 30/30 |
| 2,753,627 | A * | 7/1956 | Isroff et al. | 30/526 |
| 3,430,341 | A * | 3/1969 | Choate | 30/40 |
| 3,619,900 | A * | 11/1971 | Matsuura | 30/40 |
| 3,872,592 | A * | 3/1975 | Iten | 30/50 |
| 4,083,103 | A * | 4/1978 | Estandian | 30/47 |
| 4,257,160 | A * | 3/1981 | Murai | 30/50 |
| 4,265,015 | A * | 5/1981 | Asano | 30/47 |
| 4,461,078 | A * | 7/1984 | Carreker | 30/47 |
| 4,501,066 | A * | 2/1985 | Sceberras | 30/50 |
| 5,426,853 | A * | 6/1995 | McNinch | 30/48 |
| 5,542,178 | A * | 8/1996 | Harkleroad | 30/34.1 |
| 5,848,475 | A * | 12/1998 | Hill et al. | 30/51 |
| 6,052,905 | A * | 4/2000 | Branchinelli et al. | 30/50 |
| 6,141,875 | A * | 11/2000 | Andrews | 30/50 |
| 6,247,234 | B1 * | 6/2001 | Hill et al. | 30/34.1 |
| 6,308,416 | B1 * | 10/2001 | Bosy et al. | 30/50 |
| 6,418,623 | B1 * | 7/2002 | Marcarelli | 30/50 |
| 6,430,814 | B1 * | 8/2002 | Solow | 30/47 |
| 6,434,828 | B1 * | 8/2002 | Andrews | 30/50 |
| 7,086,160 | B2 * | 8/2006 | Coffin et al. | 30/50 |
| 7,475,481 | B1 * | 1/2009 | Napoli | 30/47 |
| 7,721,451 | B2 * | 5/2010 | Psimadas et al. | 30/527 |
| 7,761,999 | B2 * | 7/2010 | Macove | 30/34.1 |
| 8,261,451 | B2 * | 9/2012 | Macove | 30/34.1 |
| 8,381,406 | B2 * | 2/2013 | Miyazaki | 30/51 |
| 8,387,259 | B2 * | 3/2013 | Starr | 30/50 |
| 8,533,959 | B2 * | 9/2013 | Davis | 30/34.1 |
| 2002/0023352 | A1 * | 2/2002 | Mil'shtein | 30/50 |
| 2004/0035003 | A1 | 2/2004 | Stiles | |
| 2007/0283567 | A1 | 12/2007 | Magli | |
| 2008/0040936 | A1 | 2/2008 | Stiles | |
| 2013/0047449 | A1 * | 2/2013 | Zakuskin | 30/526 |
| 2013/0152400 | A1 * | 6/2013 | Nunez | 30/47 |

* cited by examiner

*Primary Examiner* — Jason Daniel Prone

(57) ABSTRACT

The divisible head razor device provides a removable blade case with two blade heads slideably disposed therein. The handle of the device terminates in a carrier having a thumb wheel within the neck. The gear shaft in turn rotates the distally disposed rack gear. Two gear arms are disposed in contact with the rack gear. Each gear arm is adjusted laterally by the thumb wheel. Each gear arm is connected to an extension, each extension connected to a vertical section, each vertical section connected to a right angle section. Two blade heads are disposed slideably side by side within the blade case. Each of the blade heads removably connects to one of each of the right angle extensions. The blade heads are controlled by the thumb wheel such that the heads can be positioned together or apart with a gap determined by a user.

3 Claims, 3 Drawing Sheets

DIVISIBLE HEAD RAZOR DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Grooming mustaches, goatees, sideburns and other bodily hair has often been a challenge to individuals wanting neat grooming that is not so difficult as to be almost personally impossible. Just using any typical form of razor, blade, or even electric trimming device still requires the user to be quite precise in device placement and use, with mistakes often occurring. Guesswork is not a desirable. Often, for example, a goatee or other facial hair may require trimming on an either side of a patch of hair or beard, with near exact hair width desired. The present device solves such hair trimming problems and challenges.

FIELD OF THE INVENTION

The divisible head razor device relates to shaving razors.

SUMMARY OF THE INVENTION

The general purpose of the divisible head razor device, described subsequently in greater detail, is to provide a divisible head razor device which has many novel features that result in an improved divisible head razor device which is not anticipated, rendered obvious, suggested, or even implied by prior art, either alone or in combination thereof.

To attain this, the divisible head razor device provides a removable blade case with two blade heads slideably disposed therein. The blade case with blades is thereby replaced when a user determines the multiple blades within the blades heads are dull. The handle of the device terminates in a carrier that tapers from a neck at the handle to an outward flare. A thumb wheel within the neck is rotated laterally by a user to turn the gear shaft. The gear shaft in turn rotates the distally disposed rack gear. Two gear arms are disposed in contact with the rack gear, one upwardly, one downwardly. Each gear arm is adjusted laterally by the thumb wheel. Each gear arm is connected to an extension that extends distally from the flare. The extensions are each connected to a vertical section, respectively. Each vertical section is connected to a right angle section that extends further distally from the flare. Two blade heads are disposed slideably side by side within the blade case. Each of the blade heads removably connects to one of each of the right angle extensions. Each blade head may house a single blade or a plurality of blades. The blade heads are controlled by the thumb wheel such that the heads can be positioned together or apart with a gap dimension determined by a user. Various hair sites may then be trimmed accurately, to an either side of the gap.

Thus has been broadly outlined the more important features of the improved divisible head razor device so that the detailed description thereof that follows may be better understood and in order that the present contribution to the art may be better appreciated.

An object of the divisible head razor device is to provide for precise hair trimming.

An object of the divisible head razor device is to provide blade heads that are centrally divisible.

Another object of the divisible head razor device is to provide for instant thumb wheel adjustment of gap between the divisible blade heads.

An added object of the divisible head razor device is to provide replaceable blade heads with blades.

These together with additional objects, features and advantages of the improved divisible head razor device will be readily apparent to those of ordinary skill in the art upon reading the following detailed description of presently preferred, but nonetheless illustrative, embodiments of the improved divisible head razor device when taken in conjunction with the accompanying drawings.

DETAILED DESCRIPTION OF THE DRAWINGS

With reference now to the drawings, and in particular FIGS. 1 through 6 thereof, the principles and concepts of the divisible head razor device generally designated by the reference number 10 will be described.

Figure 1:
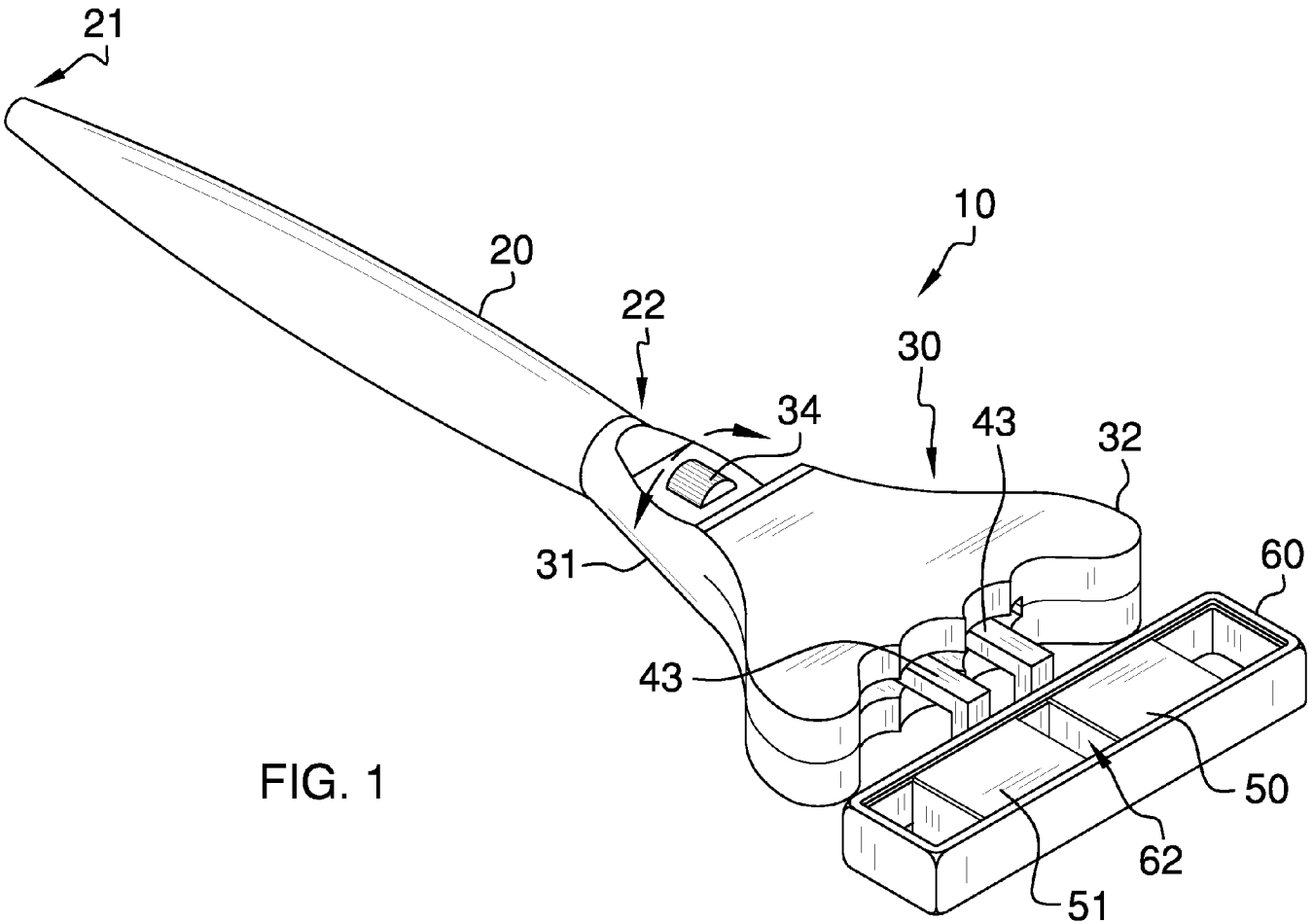
FIG. 1 is a perspective view.

Referring to FIG. 1, the device 10 partially comprises a handle 20 having a first end 21 spaced apart from a second end 22. A carrier 30 is disposed on the handle 20 second end 22. The carrier 30 has a neck 31 extended from the handle 20 second end 22, the neck tapered outwardly to a flare 32. A thumb wheel 34 is disposed in the carrier 30 neck 31. The thumb wheel 34 has a lateral rotation.

Figure 2:
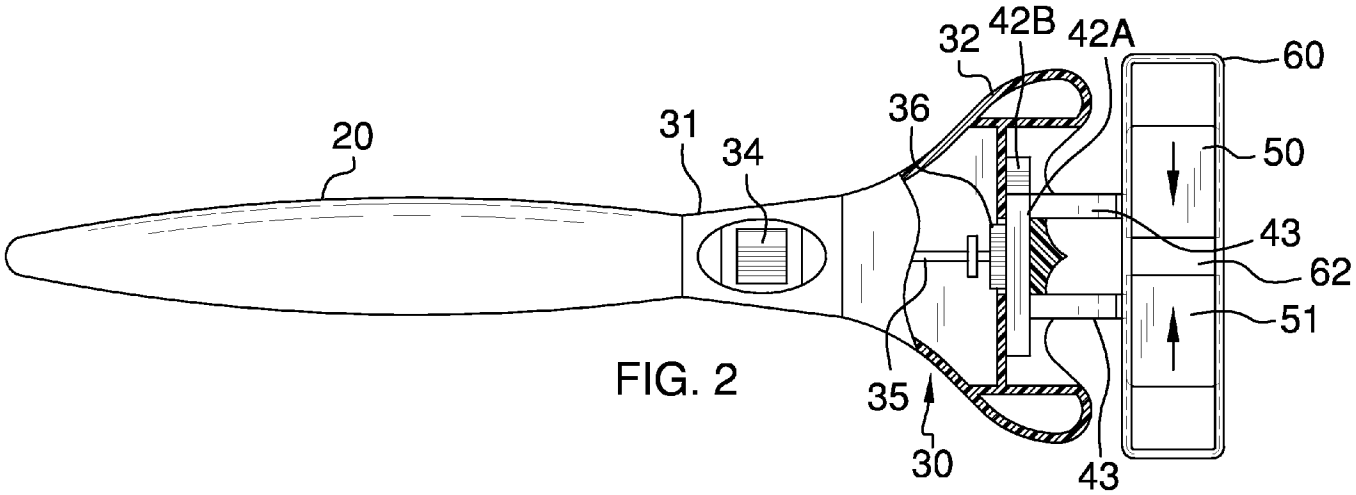
FIG. 2 is a top plan partial cross sectional view.

Referring to FIG. 2, a gear shaft 35 is extended from the thumb wheel 34 into the flare 32. A rack gear 36 is disposed distally on the gear shaft 35. The rack gear 36 is rotated laterally.

Figure 3:
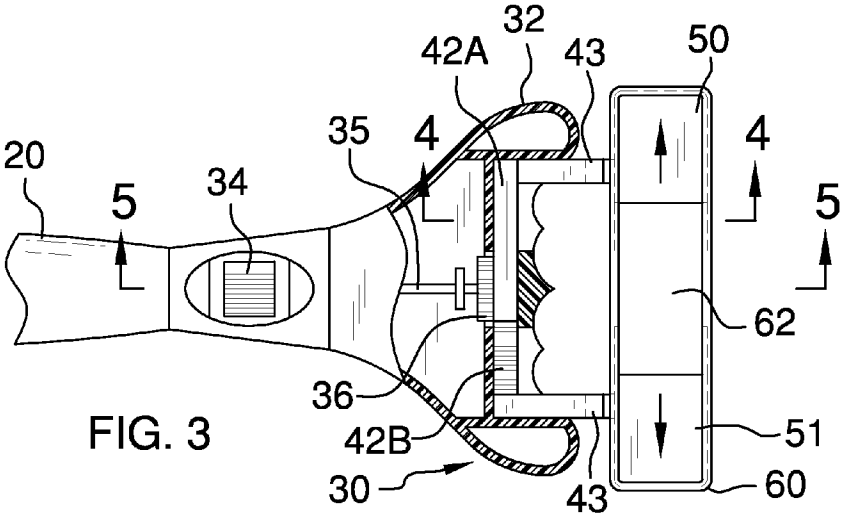
FIG. 3 is a partial top plan partial cross sectional view.
Figure 4:
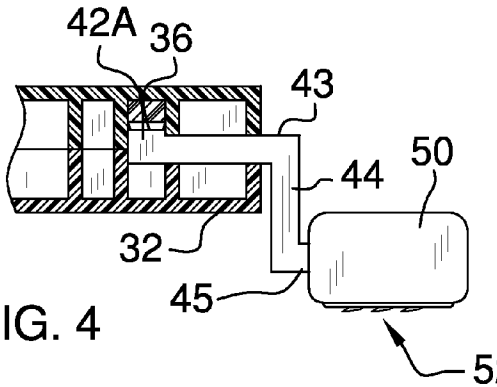
FIG. 4 is a partial cross sectional view of FIG. 3, taken along the line 4-4.

Continuing to refer to FIG. 2 and referring also to FIG. 3, an upper gear arm 40 has a first pinion gear 42A in direct communication with the rack gear 36 upwardly. A lower gear arm 41 has a second pinion gear 42B in direct communication with the rack gear 36 downwardly. An extension 43 is extended distally from each gear arm and outward from the flare 32.

Figure 5:
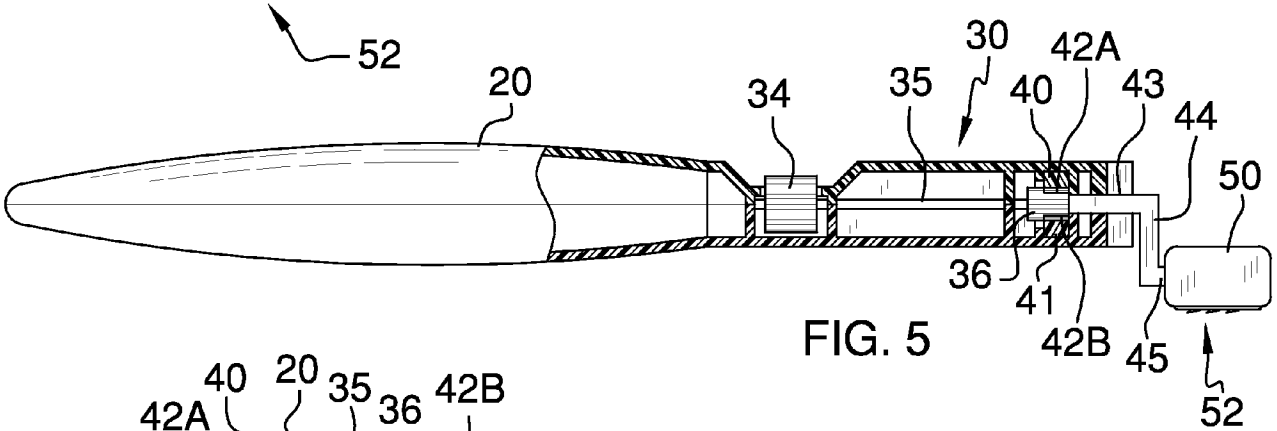
FIG. 5 is a partial cross sectional view of FIG. 3, taken along the line 5-5.

Referring to FIG. 5, a vertical section 44 is extended downwardly from each extension 43. A right angle section 45 is extended distally from each vertical section 44.

Figure 6:
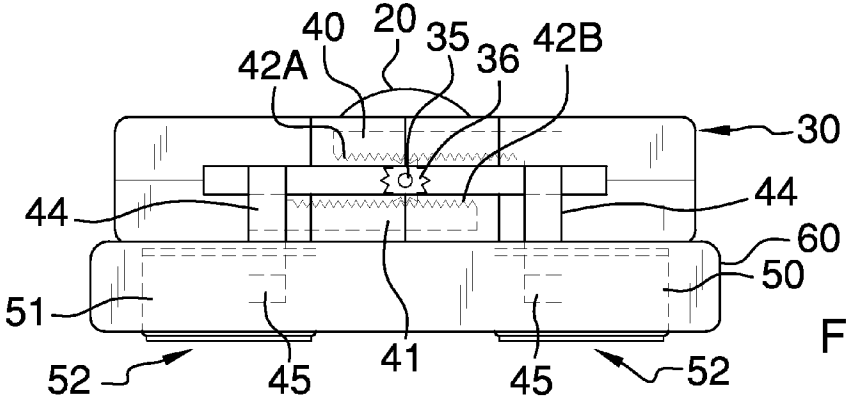
FIG. 6 is an end view of the carrier and blade case.

Referring to FIG. 6, a first blade head 50 is disposed perpendicularly and removably on the right angle section 45 in communication with the upper gear arm 40. A second blade head 51 is disposed perpendicularly and removably on the right angle section 45 in communication with the lower gear arm 41. Each blade head comprises a plurality of blades 52.

Referring again to FIG. 1, a blade case 60 houses the blade heads disposed within in a slideable state. The blade case 60 with blade heads is removable for replacement.

Referring to FIGS. 2 and 3, a movement of the thumb wheel 34 is configured to slide the blade heads together and apart, thereby selectively forming a gap 62 of user determined dimension between the first blade head 50 and the second blade head 51.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the divisible head razor device may be used.

What is claimed is:

1. A divisible head razor device comprising, in combination:

a handle having a first end spaced apart from a second end;

a carrier disposed on the handle second end, the carrier having a neck extended from the handle second end, the carrier ending in a flare;

a thumb wheel disposed in the carrier neck, the thumb wheel having a lateral rotation;

a gear shaft extended from the thumb wheel into the flare;

a rack gear disposed distally on the gear shaft, the rack gear rotated laterally;

an upper gear arm having a first pinion gear in direct lateral communication with the rack gear upwardly;

a lower gear arm having a second pinion gear in direct lateral communication with the rack gear downwardly;

an extension extended distally from each gear arm and outward from the flare;

a vertical section extended downwardly from each extension;

a right angle section extended distally from each vertical section;

a first blade head disposed perpendicularly and removably from the right angle section in communication with the upper gear arm;

a second blade head disposed perpendicularly and removably on the right angle section in communication with the lower gear arm;

at least one blade disposed downwardly from each of the blade heads;

a blade case housing the blade heads disposed within in a slideable state;

wherein a movement of the thumb wheel is configured to slide the blade heads together and apart, thereby selectively forming a user determined gap between the first blade head and the second blade head.

2. The device according to claim 1 wherein the at least one blade of each of the blade heads is a plurality of spaced apart blades.

3. The device according to claim 2 wherein the blade of each of the blade heads are equidistantly spaced apart.

* * * * *